US007717091B2

(12) United States Patent
Aoki et al.

(10) Patent No.: US 7,717,091 B2
(45) Date of Patent: May 18, 2010

(54) FUEL SUPPLY SYSTEMS

(75) Inventors: Tsuneaki Aoki, Kariya (JP); Keiso Takeda, Nagoya (JP)

(73) Assignee: Aisan Kogyo Kabushiki Kaisha, Obu-shi, Aichi-ken (JP)

( * ) Notice: Subject to any disclaimer, the term of this patent is extended or adjusted under 35 U.S.C. 154(b) by 0 days.

(21) Appl. No.: 12/145,088

(22) Filed: Jun. 24, 2008

(65) Prior Publication Data

US 2008/0314453 A1 Dec. 25, 2008

(30) Foreign Application Priority Data

Jun. 25, 2007 (JP) ..... 2007-166052

(51) Int. Cl.
*F02M 37/00* (2006.01)

(52) U.S. Cl. ..... 123/511

(58) Field of Classification Search ..... 123/511, 123/514

See application file for complete search history.

(56) References Cited

U.S. PATENT DOCUMENTS 3,025,001 A * 3/1962 Robson ..... 236/80 R
4,007,755 A * 2/1977 Lerner et al. ..... 137/101.21
4,274,380 A * 6/1981 de Vulpillieres ..... 123/456
4,310,142 A * 1/1982 Ludwig ..... 251/30.03
4,522,177 A * 6/1985 Kawai et al. ..... 123/478
5,156,133 A * 10/1992 Sugimoto et al. ..... 123/533
5,207,203 A * 5/1993 Wagner et al. ..... 123/514
5,967,119 A 10/1999 Burkhard et al.
6,170,473 B1 * 1/2001 Pontoppidan ..... 123/514
2003/0047169 A1 * 3/2003 Buse et al. ..... 123/457
2009/0126698 A1 * 5/2009 Aoki ..... 123/506

FOREIGN PATENT DOCUMENTS

DE 101 43 891 3/2003
DE 101 43 892 3/2003
DE 10 2005 036 188 2/2007
DE 11 2007 000 428 12/2008
JP 08-128370 5/1996
JP 08-144888 6/1996
JP 2001-090624 4/2001

* cited by examiner

*Primary Examiner*—Stephen K Cronin
*Assistant Examiner*—David Hamaoui
(74) *Attorney, Agent, or Firm*—Dennison, Schultz & MacDonald

(57) ABSTRACT

A fuel supply system includes a pressure regulator (16) regulating the pressure of fuel supplied from a fuel pump (14). A valve device (18) is associated with the pressure regulator (16) for controlling the pressure of the fuel regulated by the pressure regulator (16). The valve device (18) supplies a part of the fuel as a control fluid to the pressure regulator (16). The part of the fuel supplied from the valve device (18) as the control fluid is not discharged into a fuel tank (12) when the pressure regulator (16) regulates the pressure of the fuel to have a higher value.

7 Claims, 5 Drawing Sheets

FUEL SUPPLY SYSTEMS

This application claims priority to Japanese patent application serial number 2007-166052, the contents of which are incorporated herein by reference.

BACKGROUND OF THE INVENTION

1. Field of the Invention

The present invention relates to fuel supply systems used mainly for engines of vehicles.

2. Description of the Related Art

A conventional fuel supply system is shown in Japanese Laid-Open Patent Publication No. 2001-90624. FIG. 6 is a schematic structural view showing the conventional fuel supply system disclosed in this publication. As shown in FIG. 6, fuel supply system 200 includes a fuel tank 201, from which fuel is drawn and pressurized by a fuel pump 202 and passes through a fuel filter 204 and a supply pipe 203. Then the fuel is injected from each injection valve 205 into a combustion chamber of an internal combustion engine (hereinafter called "engine"). A fuel pressure regulating device 207 opens and closes a reflux control valve 224 in accordance with control signals from a control unit 229, and accordingly, pressure of fuel (hereinafter called "fuel pressure") supplied to each injection valve 205 may be switched between high pressure and low pressure.

More specifically, the fuel pressure regulating device 207 opens the reflux control valve 224, for instance when the engine starts to introduce the fuel into a control pressure chamber 208B of a pressure regulator 208, for increasing the pressure inside the control pressure chamber 208 B. Accordingly, the fuel pressure inside a fuel pressure regulating chamber 208A of the pressure regulator 208 is increased, and fuel pressure inside the supply pipe 203 communicating with the fuel pressure regulating chamber 208A is increased. Due to this, the fuel pressure supplied to each injection valve 205 becomes high to enhance atomization of the injected fuel, and accordingly, starting performance of the engine is improved. The fuel inside the fuel regulating chamber 208A is then refluxed into a fuel tank 201 via a delivery pipe path 223. The reflux control valve 224 is closed after starting the engine so that the pressure inside the pressure control chamber 208B of the pressure regulator 208 is decreased. Therefore, the fuel pressure inside the fuel regulating chamber 208A and the supply pipe 203 is decreased. Accordingly, the fuel pressure supplied to each injection valve 205 becomes low, and therefore, load on the fuel pump 202 etc. is reduced.

In the conventional fuel supply system (see FIG. 6), the fuel introduced into the fuel pressure regulating chamber 208A of the pressure regulator 208 during the pressurization, flows into the fuel tank 201 via the delivery pipe path 223. As a result, the efficiency of pump is decreased due to the large loss of fuel flow volume.

Therefore, there has been a need for a fuel supply system that can prevent the loss of fuel flow volume during the pressurization, which can improve the efficiency of the pump.

SUMMARY OF THE INVENTION

One aspect according to a fuel supply system of the present invention includes a pressure regulator for regulating the pressure of fuel supplied from a fuel pump. A valve device is associated with the pressure regulator for controlling the pressure of the fuel regulated by the pressure regulator. The valve device supplies a part of the fuel as a control fluid to the pressure regulator. The part of the fuel supplied from the valve device as the control fluid is not discharged into a fuel tank when the pressure regulator regulates the pressure of the fuel to have a higher value.

DETAILED DESCRIPTION OF THE INVENTION

Figure 1:
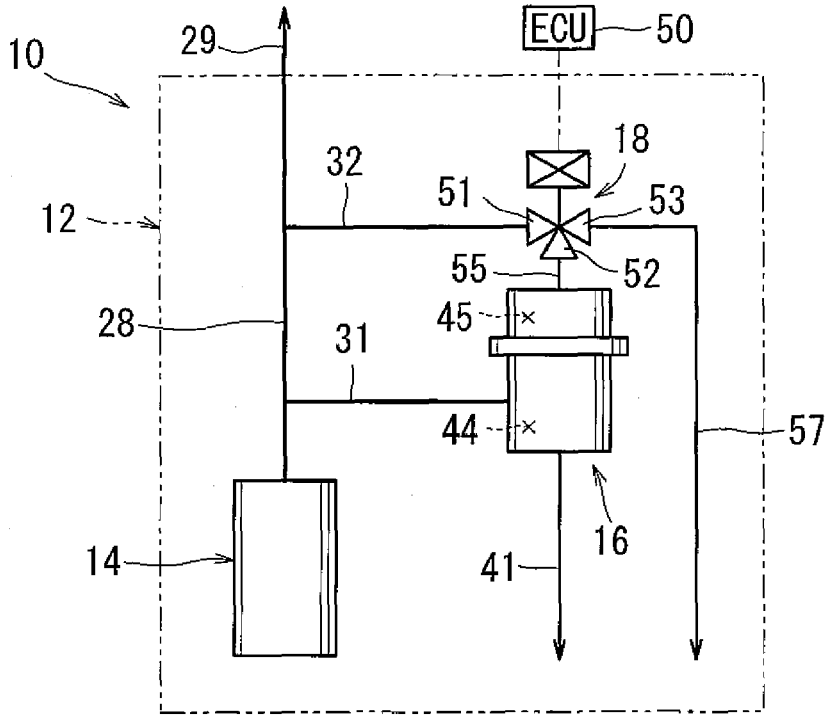
FIG. 1 is the schematic structural view showing a fuel supply system according to a first embodiment of the present invention.

Each of the additional features and teachings disclosed above and below may be utilized separately or in conjunction with other features and teachings to provide improved fuel supply systems. Representative examples of the present invention, which examples utilize many of these additional features and teachings both separately and in conjunction with one another, will now be described in detail with reference to the attached drawings. This detailed description is merely intended to teach a person of skill in the art further details for practicing preferred aspects of the present teachings and is not intended to limit the scope of the invention. Only the claims define the scope of the claimed invention. Therefore, combinations of features and steps disclosed in the following detailed description may not be necessary to practice the invention in the broadest sense, and are instead taught merely to particularly describe representative examples of the invention. Moreover, various features of the representative examples and the dependent claims may be combined in ways that are not specifically enumerated in order to provide additional useful embodiments of the present teachings.

One embodiment of a fuel supply system of the present invention includes a fuel tank for storing fuel, a fuel pump for supplying the fuel inside the fuel tank to outside of the fuel tank, a fuel pressure regulating chamber and a control pressure chamber being defined by a movable partition wall and each configured for introducing a portion of the fuel discharged from the fuel pump, a pressure regulator for regulating the fuel pressure inside the fuel pressure regulating chamber and for returning surplus fuel to the fuel tank, and a valve device controlled by a control device for changing the fuel pressure supplied to outside of the fuel tank by selectively switching between the introduction of the fuel and the introduction of air into the pressure regulating chamber of the pressure regulator.

According to the above fuel supply system, the fuel inside the fuel tank is drawn and pressurized (energized) by the fuel pump, regulated by the pressure regulator to be a pre-determined value, and then supplied to the outside of the fuel tank. The valve device is controlled by the control device and the introduction of the fuel and introduction of air into the pressure regulating chamber of the pressure regulator may be selectively switched. More specifically, the valve device blocks the introduction of the fuel when it introduces the air into the control pressure chamber of the pressure regulator. Whereas, the valve device blocks the introduction of the air when it introduces the fuel into the control pressure chamber of the pressure regulator. Accordingly, the fuel pressure inside the fuel pressure regulating chamber of the pressure regulator (in other words, the fuel pressure supplied to outside of the fuel tank) may be changed. When the fuel is introduced into the control pressure chamber of the pressure regulator, the introduction of the air into the control pressure chamber is blocked by the valve device. When the pressure to a movable partition wall (in the control pressure chamber) is increased due to the fuel introduction into the pressure regulating chamber of the pressure regulator, the flow of the fuel into the atmosphere is prevented. Accordingly, the loss of the fuel flowing inside the control pressure chamber 45 during pressurization is inhibited, and thus, the efficiency of the pump is increased.

The fuel introduced into the pressure regulating chamber of the pressure regulator may be a pressurized fuel after pressurization by the fuel pump and before being discharged from the fuel pump. According to this configuration, the pressurized fuel after pressurization by the fuel pump and before being discharged from the fuel pump may be introduced into the control pressure chamber of the pressure regulator.

The fuel supply system may include a pressure relief valve for regulating the fuel pressure inside the pressure regulating chamber of the pressure regulator to be below a pre-determined value. According to this configuration, the fuel pressure inside the control pressure regulating chamber of the pressure regulator is controlled to be below the pre-determined pressure by the pressure relief valve.

The valve device may be a three way valve. Because the valve device is the three-way valve, the introduction of the fuel and the introduction of the air into the control pressure chamber of the pressure regulator may be selectively switched. Accordingly, compared to utilizing a plural number of valve devices, the construction of the fuel supply system may be simplified In another embodiment of the present invention, a fuel supply system includes a fuel tank constructed to store fuel; a fuel pump constructed to pump the fuel from the fuel tank and supplying the fuel to an engine via a first path; a pressure regulator constructed to adjust a pressure of the fuel supplied to the engine based on a pressure of a control fluid; a control valve associated with the pressure regulator and constructed to control the supply of the control fluid to the pressure regulator; and a second path connecting between the fuel pump and the control valve, so that a par of the fuel supplied from the fuel pump serves as the control fluid. The control valve is operable between a first position and a second position. When the control valve is in the first position, the part of the fluid as the control fluid is discharged from the control valve into the fuel tank without being supplied to the pressure regulator, so that the pressure of the fluid supplied to the engine is controlled to have a first pressure value. When the control valve is in the second position, the part of the fuel as the control fluid is supplied from the control valve to the pressure regulator without being discharged into the fuel tank, so that the pressure of the fluid supplied to the engine is controlled to have a second pressure value that is higher than the first value.

Embodiments of the present invention will be described with reference to the drawings.

First Embodiment

A first embodiment of the present invention will be explained below. This embodiment can be used as a fuel supply system for a vehicle. FIG. 1 is a schematic structural view showing the fuel supply system. As shown in FIG. 1, a fuel supply system 10 is installed on a vehicle, which is not shown in the drawings, and has a fuel tank 12 for storing fuel, a fuel pump 14 located inside the fuel tank 12, a pressure regulator 16 and a valve device 18.

Figure 2:
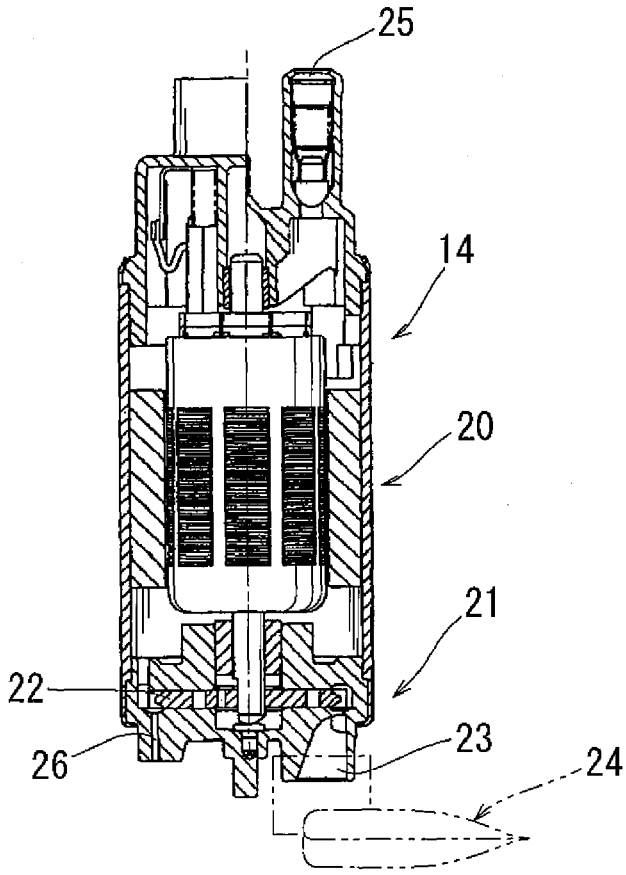
FIG. 2 is a cross-sectional view showing a fuel pump.

The fuel pump 14 is supported within the fuel tank 12 via a supporting member (not shown), and supplies the fuel from the fuel tank 12 to outside of the fuel tank 12. FIG. 2 is a cross sectional view showing the fuel pump 14. As shown in FIG. 2, the fuel pump 14 is a motor-integrated pump and has an electric motor section 20 and an impeller pump section 21 installed on the bottom end of the motor section 20. When an impeller 22 rotates due to the drive of the motor section 20, the pump section 21 draws and pressurizes the fuel inside the fuel tank 12 and then discharges the fuel into the motor section 20. A fuel intake opening 23 for drawing the fuel is located on the bottom surface of the fuel pump 14. An intake filter 24 for filtering the fuel drawn from the fuel tank 12 into the fuel pump 14 is connected to the fuel intake opening 23 via a pipe. On the upper surface of the fuel pump 14, a fuel discharge opening 25 for discharging the fuel passing through the motor section 20 is placed. On the bottom surface of the fuel pump 14, a vapor jet 26 for ejecting (in other words, discharging) vapor (air bubbles generated due to evaporation of the fuel) contained in the fuel during pressurization inside the pump section 21 is provided. The vapor jet 26 may be also called a "vapor fuel discharging opening."

As shown in FIG. 1, the fuel pump 14 (specifically, the fuel discharge opening 25 (see FIG. 2)) is connected with one end of a tank interior fuel supply path 28. A tank exterior fuel supply path 29 located outside of the fuel tank 12 is connected with the other end of the tank interior fuel supply path 28. The downstream-side end (i.e. the engine-side end of the tank), exterior fuel supply path 29 is connected to a delivery pipe which is not shown in the drawings. The delivery pipe has fuel injection valves, in other words, injectors corresponding to combustion chambers (not shown). Accordingly, the fuel pressurized by the fuel pump 14 is discharged into the tank interior fuel supply path 28, and then supplied to the tank exterior fuel supply path 29. The fuel supplied into the tank exterior fuel supply path 29 is injected from each injector into each combustion chamber of the engine via the delivery pipe.

A first communicating path 31 and a second communicating path 32 are branched from the tank interior fuel supply path 28. The downstream-side end of the first communicating path 31 is communicated with a fuel pressure regulating chamber 44 of the pressure regulator 16 (described below). The downstream-side end of the second communicating path 32 is communicated with a first connection port 51 of the valve device 18 (described below).

Figure 3:
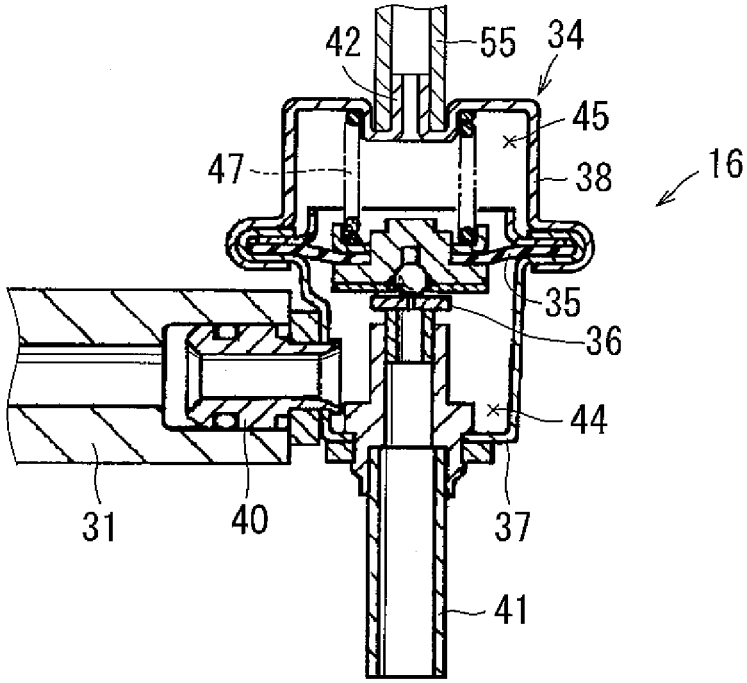
FIG. 3 is a cross-sectional view showing the pressure regulator.

The pressure regulator 16 is supported inside the fuel tank 12 with a supporting member which is not shown in the drawings, and regulates pressure of the fuel, in other words, the fuel pressure supplied to the tank exterior fuel supply path 29. FIG. 3 is a cross sectional view showing the pressure regulator. As shown in FIG. 3, the pressure regulator 16 has a casing 34, a diaphragm 35, and a valve element 36. The casing 34 constitutes an outer shell of the pressure regulator 16. The casing 34 is comprised of a case 37 and a case 38 coupled to each other. The case 37 has an opening on the upper surface located on the side of the fuel pressure regulating chamber 44. The case 38 has an opening on the bottom surface located on the side of the control pressure chamber 45. On the side wall portion of the case 37 on the side of the fuel pressure regulating chamber 44, a fuel introduction pipe 40 is provided. On the bottom wall portion of the case 37, a fuel ejection pipe 41 is provided. On the upper wall portion of the case 38, a communication opening 42 is provided.

The diaphragm 35 is clamped between the case 37 of the fuel pressure regulating chamber side and the case 38 of the control pressure chamber side, and divides the, casing 34 into the fuel pressure regulating chamber 44 and the control pressure chamber 45. The diaphragm 35 is made of a rubber-like resilient material and thus, has flexibility. The valve element 36 is installed in the center of the diaphragm 35 and faces against the upper end surface of the fuel ejection pipe 41. The upper open end of the fuel election pipe 41 serves as a valve seat. The valve element 36 opens or closes the upper open end of the fuel ejection pipe 41 due to flexural deformation of the diaphragm 35 for permitting and interrupting communication of the inside of the fuel pressure regulating chamber 44 with the inside of the fuel ejection pipe 41. The diaphragm 35 may be also called as a "moveable partition wall".

Inside the control pressure chamber 45, a valve spring 47 configured as a coil spring is interposed between the upper wall portion of the case 38 on the side of the control pressure chamber 45, and the valve element 36 of the diaphragm 35. The valve spring 47 always biases the valve element 36 towards the seating direction on the valve seat of the fuel ejection pipe 41, in other words, the valve closing direction. Therefore, when the fuel pressure inside the pressure regulating chamber 44 for pressing the diaphragm 35 is lower than the force inside the control pressure chamber 45 for pressing the diaphragm 35, in other words, resilient force of the valve spring 47, the valve element 36 seats on the fuel ejection pipe 41 due to the resilient force of the valve spring 47, and the fuel ejection pipe 41 is closed. When the fuel pressure inside the fuel pressure regulating chamber 44 (in other words, the fuel pressure) pressing the diaphragm 35 is higher than the resilient force of the valve spring 47, due to the flexural deformation of the diaphragm 35, the valve element 36 moves away from the fuel ejection pipe 41, and the fuel ejection pipe 41 is opened. Accordingly, the fuel inside the fuel pressure regulating chamber 44 is ejected via the fuel ejection pipe 41, and the fuel pressure in the fuel pressure regulating chamber 44 is lowered to be a pre-determined value. When the fuel pressure in the fuel pressure regulating chamber 44 has become the pre-determined value, the valve material 36 is closed due to the resilient force of the valve spring 47.

Referring to FIG. 1, a valve device 18 is an electromagnetically switchable three way valve and supported inside the fuel tank 12 by the supporting member which is not shown in the drawing. The valve device 18 has a first to a third, altogether three connection ports 51, 52 and 53 and is switched on and off based on control signals that are outputted from the electronic control unit 50 ("ECU").

The ECU 50 is a control unit that can include a microcomputer, and is connected with a detecting device such as an ignition switch or a starting switch of an engine at the input side and an injector at the output side. The ECU 50 also is set to perform on and off control depending on the operating condition of the engine. For example, the ECU 50 switches on (ON) the valve device 18 until a pre-determined amount of time passes after starting the engine (from switching on of the ignition switch or the starting switch) and switches off the valve device 18 (OFF) after the pre-determined amount of time passes. When the valve device 18 is switched on, the first connection port 51 and the second connection port 52 are connected with each other, and the third connection port 53 is blocked. When the valve device 18 is switched off, the first connection port 51 is blocked, and the second connection port 52 and the third connection port 53 are connected with each other. The ECU 50 may be called as a "control unit."

As shown in FIG. 1, the first communicating path 31 is connected with the fuel introduction pipe 40 (See FIG. 3) of the pressure regulator 16, and communicates with the fuel pressure regulating chamber 44 of the pressure regulator 16. The first connecting path 31 may be called as a "communicating path on the fuel pressure regulating chamber side." As shown in FIG. 1, the second connection port 52 of the valve device 18 and the communication port 42 of the pressure regulator 16 (See FIG. 3) communicate via a relay pipe path 55.

The second communicating path 32 is connected with the first connecting port 51 of the valve device 18. The second communicating path 32 may be called as a "communicating path on the control pressure chamber side." A fuel discharge pipe 57 is connected with the third connection port 53 of the valve device 18. The fuel discharge pipe 57 and the fuel ejection pipe 41 of the pressure regulator 16 are open inside the fuel tank 12.

The operation of the fuel supply system 10 will now be explained. When the engine starts the valve device 18 is switched on according to the control signals output from the ECU 50. The first connecting port 51 and the second connecting port 52 then communicate with each other and the third connecting port 53 is blocked. Under this condition, a portion of the fuel (inside the tank internal fuel supply path 28) flows into the control pressure chamber 45 of the pressure regulator 16 via the second communicating path 32 and the relay pipe path 55. At this time, due to the brokerage of the third connecting port 53, the fuel inside the control pressure chamber 45 is prevented from flowing into the fuel tank 12 via a fuel effluent pipe 57.

When the portion of the fuel flowing inside of the tank internal fuel supply path 28 flows into the control pressure chamber 45 of the pressure regulator 16, the fuel pressure inside the control pressure chamber 45 is increased. Accordingly, the diaphragm 35 of the pressure regulator 16 (See FIG. 3) deforms in a flexural manner towards the fuel pressure regulating chamber 44 and the valve element 36 seats on the valve seat of the fuel ejection pipe 41. As a result, the flow of the fuel inside the fuel pressure regulating chamber 44 into the fuel tank 12 through the fuel ejection pipe 41 is prevented. Accordingly, the fuel pressure inside the fuel pressure regulating chamber 44 is further increased. When the fuel pressure inside the fuel pressure regulating chamber 44 of the pressure regulator 16 becomes higher than the fuel pressure of the control pressure chamber 45, the diaphragm 35 deforms in a flexural manner towards the control pressure chamber 45 and when the valve element 36 has moved away from the valve seat of the fuel ejection pipe 41, the fuel inside the fuel regulating chamber 44 is ejected into the fuel tank 12 via the fuel ejection pipe 41. When the fuel pressure inside the fuel pressure regulating chamber 44 drops again, the diaphragm 35 deforms in flexural manner towards the fuel pressure regulating chamber 44 and the valve element 36 seats on the valve seat of the fuel ejection pipe 41. In this way, the fuel pressure inside the fuel pressure regulating chamber 44, in other words, the fuel pressure supplied to outside of the fuel tank 12 (engine) is regulated to a pressure for instance, around 600 kPa which is higher than a normal pressure.

As explained above, because the fuel pressure supplied to the outside of the fuel tank 12 (engine) is regulated to a high fuel pressure by the pressure regulator 16, atomization of the injected fuel from the injector is enhanced, and accordingly, the starting performance of the engine is improved. The valve device 18 remains switched on (a starter switch, such as an ignition switch or a start switch, remains to be switched on (ON)) from the start of the engine until a pre-determined amount of time passes.

When the pre-determined amount of time has passed after starting of the engine, the valve device 18 is switched off by the control signals output from the ECU 50. The first connection port 51 of the valve device 18 is then blocked and the second connection port 52 and the third connection port 53 are communicated. Under this condition, a portion of the fuel flowing inside the tank interior fuel supply path 28 is not able to flow via the relay pipe path 55 from the second communicating path 32 and thus, the fuel is prevented from flowing into the control pressure chamber 45 of the pressure regulator 16. Due to this, the pressure acting on the diaphragm 35 inside the pressure regulating chamber 45 is only the resilient force of the valve spring 47. Accordingly, the fuel pressure inside the fuel pressure regulating chamber 44 of the pressure regulator 16 (in other words, the pressure of the fuel supplied to the outside of the fuel tank 12 (engine)) is regulated to a normal pressure, for instance, around 400 kPa.

As explained above, because the pressure of the fuel supplied to the outside of the fuel tank 12 (engine) is regulated to the normal pressure by the pressure regulator 16, the load on the fuel pump 14 etc. may be reduced. The condition that the valve device 18 is switched on may be called as a "high pressure condition." Whereas, the condition that the valve device is switched off may be called as a "normal pressure condition."

According to the fuel supply system 10 (see FIG. 1), because the ECU 50 controls the valve device 18, introduction of fuel or air into the control pressure chamber 45 of the pressure regulator 16 may be selectively switched. More specifically, the valve device 18 blocks the introduction of the fuel for introducing air into the pressure control chamber 45 of the pressure regulator 16 (see the above explained normal pressure condition). Whereas, the valve device 18 blocks the introduction of the air for introducing the fuel into the pressure regulating chamber 45 of the pressure regulator 16 (See the above explained high pressure condition). Accordingly, the valve device 18 is operable to change the fuel pressure inside the fuel pressure regulating chamber 44 of the pressure regulator 16, in other words, the pressure of the fuel supplied to the outside of the fuel tank 12.

When the fuel is to be introduced into the control pressure chamber 45 of the pressure regulator 16 (the high pressure condition), the valve device 18 blocks the introduction of air into the control pressure chamber 45. Accordingly, when the pressure against the diaphragm 35 (see FIG. 3) inside the control pressure chamber 45 is increased due to the fuel introduction into the control pressure camber 45 of the pressure regulator 16, the flow of the fuel into the atmosphere is prevented. Accordingly, the loss of the fuel flowing inside the control pressure chamber 45 during pressurization is inhibited, and thus, the efficiency of the pump is increased.

The fuel discharged from the fuel discharge opening 25 (see FIG. 2) of the fuel pump 14 (i.e. the fuel pressurized by the fuel pressure pump 14) may be introduced into the control pressure chamber 45 of the pressure regulator 16. Alternatively, the fuel discharged from a second discharge opening (pressurized fuel with the discharged fuel pressure) which is separately installed from the fuel discharge opening 25 of the fuel pump 14 may be introduced into the control pressure chamber 45.

Because the valve device 18 is a three-way valve, one valve device 18 may selectively switch between the introduction of the fuel and the introduction the air into the pressure regulating chamber 45 of the pressure regulator 16. Accordingly, the construction of the fuel supply system may be simplified compared to utilizing a plural number of valve devices that allow to selectively switch between the introduction of the fuel and the introduction of air into the control pressure chamber 45 of the pressure regulator 16.

In an example of utilizing the plural number of valve devices, the valve device 18 and the relay pipe path 55 is omitted, the second communicating path 32 and a fuel discharge pipe 57 are individually connected with the pressure regulating chamber 45 of the pressure regulator 16, valve devices (i.e. electromagnetic on-off valves) are respectively installed to the second communicating path 32 and the fuel discharge pipe 57. Due to the open-close control of the valve devices by the ECU 50, the introduction of the fuel and the introduction of the air into the control pressure chamber 45 of the pressure regulator may be selectively switched. Therefore, selectively switching the introduction of the fuel and the introduction of the air into the control pressure chamber 45 of the pressure regulator 16 utilizing a plural number of valve devices is also within the scope of the present invention.

Second Embodiment

Figure 4:
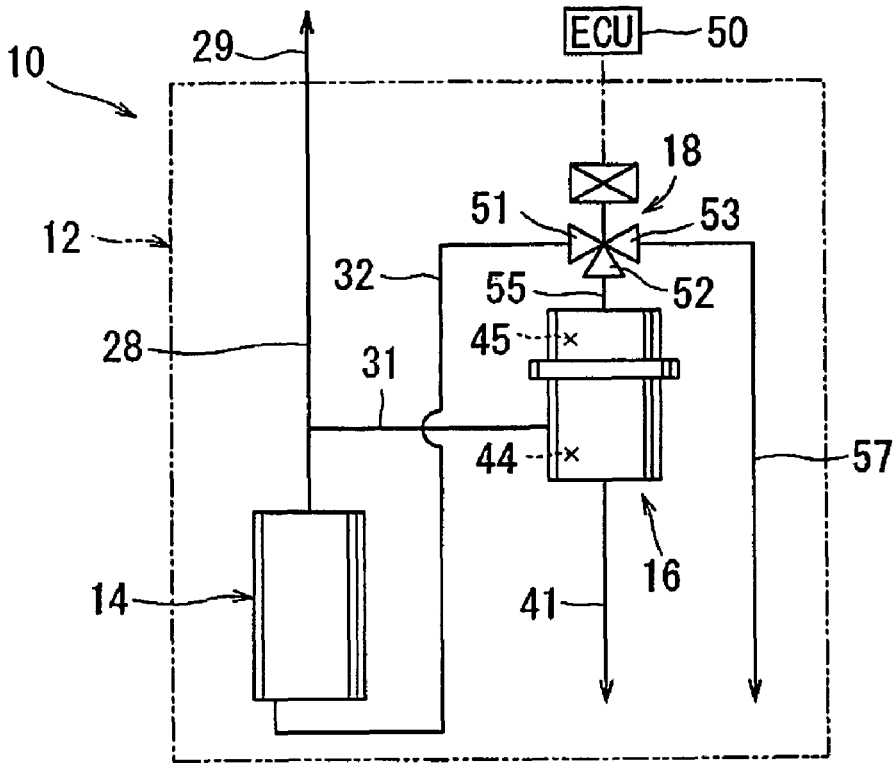
FIG. 4 is a schematic view showing a fuel supply system of a second embodiment of the present invention.

A second embodiment of the present invention will be explained below. The second embodiment is a modification of the first embodiment. Therefore, explanation is provided for the modified parts only and explanation for the parts that are the same or similar to the first embodiment will not be repeated. FIG. 4 shows a schematic structural view of the fuel supply system. As shown in FIG. 4, in this embodiment, the second connecting path 32 branched from the tank interior fuel supply path 28 inside the fuel supply system 10 in the first embodiment, is communicated with the vapor jet 26 (see, FIG. 2) of the fuel pump 14 instead of the tank interior fuel supply path 28. Accordingly, the fuel discharged from the vapor jet 26 of the fuel pump 14 is introduced into the second connecting path 32. Therefore, when the valve device 18 is switched on by the ECU 50, the fuel discharged from the vapor jet 26 of the fuel pump 14 flows into the control pressure chamber 45 of the pressure regulator 16 via the second connecting path 32 and the relay pipe path 55.

The same effect with the first embodiment may also be achieved based on this embodiment. The fuel discharged from the vapor jet 26 (see FIG. 2) of the fuel pump 14 (the fuel inside the fuel pump 14 which is on the pressurizing process) may be introduced into the control pressure chamber 45 of the pressure regulator 16. Further, the fuel discharged from a second vapor jet which is separately disposed from the vapor jet 26 of the fuel pump 14 (the pressurized fuel during pressurizing process) may be introduced inside the control pressure chamber 45 of the pressure regulator 16. Accordingly, due to the introduced fuel, the pressure inside the control pressure chamber 45 of the pressure regulator 16 may be set at any pressure value.

Third Embodiment

Figure 5:
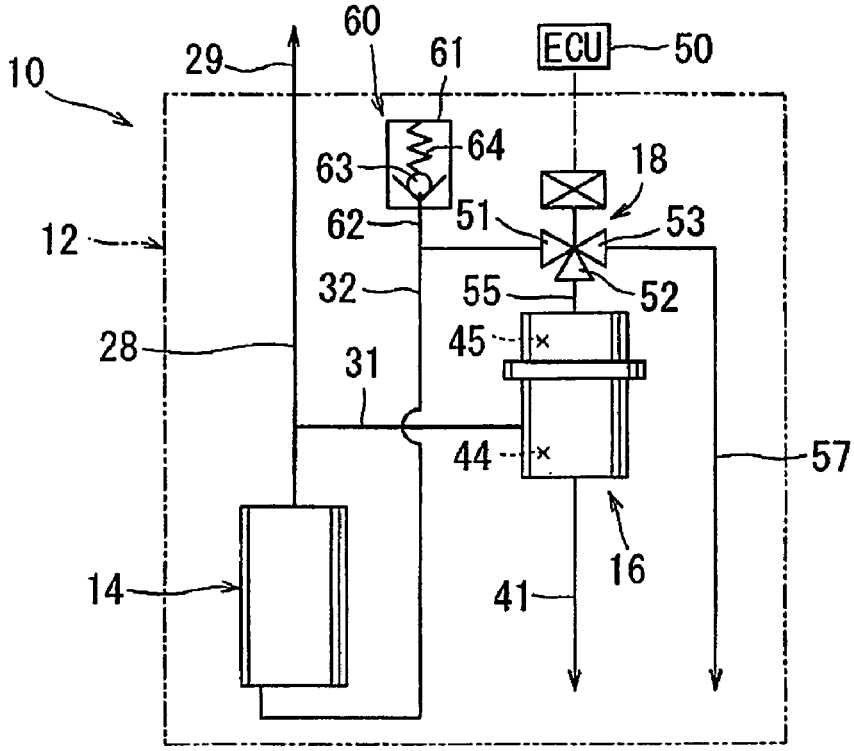
FIG. 5 is a schematic view showing a fuel supply system of a third embodiment of the present invention.
Figure 6:
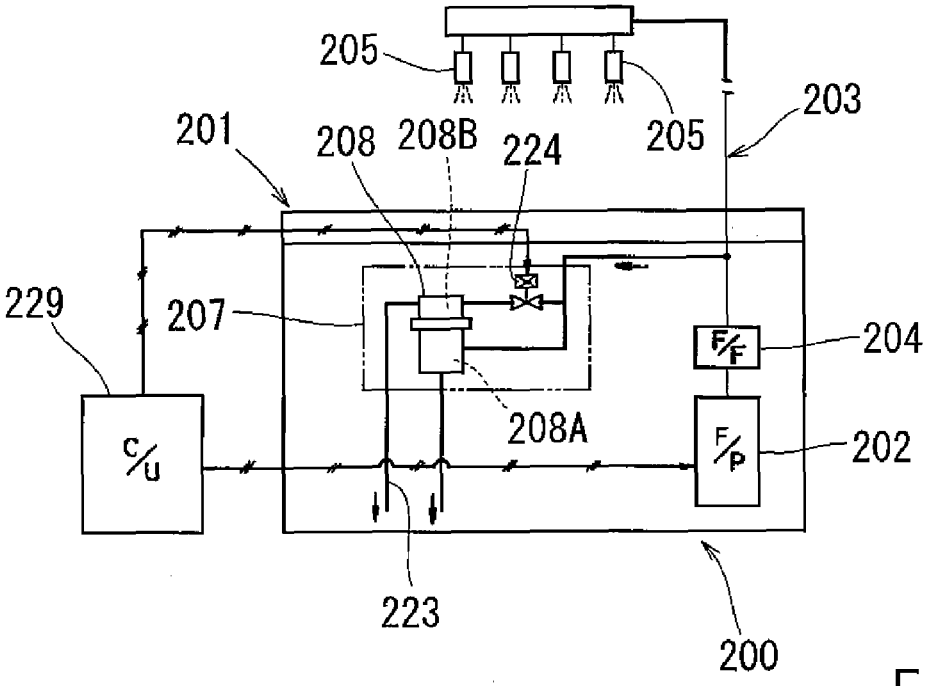
FIG. 6 PRIOR ART
FIG. 6 is a schematic view showing a conventional fuel supply system.

A third embodiment of the present invention will be explained below. The third embodiment is a modification of the second embodiment. Therefore, explanation is provided for the modified parts only and explanation for the parts that are the same or similar to the second embodiment will not be repeated. FIG. 5 is a schematic structural view of the fuel supply system. As shown in FIG. 5, in this embodiment, a pressure relief valve 60 (also called as a "pressure release valve") is disposed on the second connecting path 32 in the fuel supply system 10 in the second embodiment (see FIG. 4).

The pressure relief valve 60 is supported inside the fuel tank with a supporting member which is not shown in the drawings, and controls the fuel pressure introduced into the control pressure chamber 45 of the pressure regulator 16 to be below the pre-determined pressure.

The relief valve 60 has a case 61, a relief path 62 communicating between the inside and outside of the case 61 and communicating with the a midway of the second communicating path 32, a valve member 63 that can open and close the relief path 62, and a spring 64 resiliently pressing the valve member 63 in a closing direction. When the fuel pressure inside the second connecting path 32 becomes higher than the resilient force of the spring 64, the valve member 63 is opened due to the resiliency of the spring 64, and the fuel inside the second communicating path 32 is released via the relief path 62 and accordingly, the pressure within the second communicating path 32 is lowered until it becomes a predetermined pressure. When the fuel pressure inside the control pressure chamber 45 becomes a pre-determined value, the valve member 63 is closed due to the resiliency of the spring 64.

The same effect with the first embodiment can be achieved based on this embodiment. The fuel pressure inside the second communicating path 32 (in other words, the fuel pressure inside the control pressure chamber 45 of the pressure regulator 16) may be controlled to be below the pre-determined pressure by the pressure relief valve 60. Further, the relief path 62 of the pressure relief valve 60 may communicate with the control pressure chamber 45 instead of communicating with the fuel path (the second communicating path 32), the pressure inside which is the same with the fuel pressure inside the control pressure chamber 45 of the pressure regulator 16.

The present invention is not limited to the embodiments discussed above and may be modified without departing from the scope of the present invention.

This invention claims:

1. A fuel supply system comprising:

a fuel tank for storing fuel;

a fuel pump for supplying the fuel inside the fuel tank to outside of the fuel tank;

a pressure regulator comprising a fuel pressure regulating chamber and a control pressure chamber defined by a movable partition wall and each configured for introducing a portion of the fuel discharged from the fuel pump;

wherein the pressure regulator regulates the fuel pressure inside the fuel pressure regulating chamber and returns surplus fuel into the fuel tank;

a valve device being controlled by the control device for changing the fuel pressure supplied to outside of the fuel tank by selectively switching between the introduction of the fuel and the introduction of air into the control pressure chamber of the pressure regulator; and a pressure relief valve for regulating the fuel pressure inside the control pressure chamber of the pressure regulator to be below a predetermined value;

wherein the fuel pump can pressurize the fuel to a predetermined pressure, and the pressure of the fuel introduced into the control pressure chamber is lower than the predetermined pressure.

2. The fuel supply system as in claim 1, wherein the valve device is a three way valve.

3. The fuel supply system as in claim 2, wherein the three way valve includes a first port connected to a fuel path for introducing the portion of the fuel discharged from the fuel pump into the pressure regulator, a second port connected to the control pressure chamber, and a third port open into the fuel tank; and when the control valve is in the first position, the first port does not communicate with any of the second port and the third port, while the second port and the third port communicate with each other, and when the control valve is in the second position, the first port and the second port communicate with each other, while the third port does not communicate with any of the first port and the second port.

4. The fuel supply system as in claim 1, wherein the valve device is disposed within a communication path communicating between the control pressure chamber and the fuel pump, and the relief valve is disposed on an upstream side of the valve device within the communication path.

5. A fuel supply system comprising:

a fuel tank for storing fuel;

a fuel pump for supplying the fuel inside the fuel tank to outside of the fuel tank;

a pressure regulator comprising a fuel pressure regulating chamber and a control pressure chamber defined by a movable partition wall and each configured for introducing a portion of the fuel discharged from the fuel pump;

wherein the pressure regulator regulates the fuel pressure inside the pressure regulating chamber and returns surplus fuel into the fuel tank; and a valve device being controlled by a control device for changing the fuel pressure supplied to outside of the fuel tank by selectively switching between the introduction of the fuel and the introduction of air into the control pressure chamber of the pressure regulator;

wherein the fuel pump can pressurize the fuel to a predetermined pressure, and the pressure of the fuel introduced into the control pressure chamber is lower than the predetermined pressure.

6. The fuel supply system as in claim 1, wherein:

the fuel pump includes a first discharge port communicating with the fuel pressure regulating chamber and a second discharge port communicating with the control pressure chamber;

the second discharge port is positioned on an upstream side of the first discharge port within the fuel pump;

the fuel having the predetermined pressure is discharged from the first discharge port; and the fuel having the pressure lower than the predetermined pressure is discharged from the second discharge port.

7. The fuel supply system as in claim 5, wherein:

the fuel pump includes a first discharge port communicating with the fuel pressure regulating chamber and a second discharge port communicating with the control pressure chamber;

the second discharge port is positioned on an upstream side of the first discharge port within the fuel pump;

the fuel having the predetermined pressure is discharged from the first discharge port; and the fuel having the pressure lower than the predetermined pressure is discharged from the second discharge port.

* * * * *